United States Patent [19]

Thorne

[11] Patent Number: 4,687,908

[45] Date of Patent: Aug. 18, 1987

[54] CONVECTION BLOWER FOR CONVENTIONAL ELECTRIC OVENS

[75] Inventor: Kenneth W. Thorne, Hayward, Calif.

[73] Assignee: Parallel Industries, Inc., Sonoma, Calif.

[21] Appl. No.: 812,353

[22] Filed: Dec. 23, 1985

[51] Int. Cl.[4] ..... A21B 1/22; F01D 1/02

[52] U.S. Cl. ..... 219/400; 415/211; 126/21 A

[58] Field of Search ..... 219/400; 126/21 A, 21 R; 415/211; 417/354, 424; 416/170 C

[56] References Cited

U.S. PATENT DOCUMENTS

| | | | |
|---|---|---|---|
| 594,206 | 11/1897 | Jeffreys | 415/211 |
| 2,142,842 | 1/1939 | Hanson | 417/424 |
| 2,652,193 | 9/1953 | Lindberg | 417/424 |
| 2,694,157 | 11/1954 | Cone | 417/424 |
| 2,774,293 | 12/1956 | Jenn | 417/424 |
| 3,246,690 | 4/1966 | Fry | 219/400 |
| 4,369,760 | 1/1983 | Jorgensen | 126/21 A |
| 4,561,416 | 12/1985 | Loechner | 126/21 A |

*Primary Examiner*—E. A. Goldberg
*Assistant Examiner*—Teresa J. Walberg
*Attorney, Agent, or Firm*—Flehr, Hohbach, Test, Albritton & Herbert

[57] ABSTRACT

An energy saving, readily removable, portable electric blower for retrofit to conventional 230 volt electric ovens is placed on the oven floor between the heat elements to circulate air through the oven in various directions. One wire of the 115 volt blower motor is coupled by a wire protecting spring metal clip to an element opening in the oven wall for its neutral electrical connection, the second motor wire is coupled to an element conductor so that the blower motor is energized by an oven selector switch. The use of this convection blower can be shown to annually save an average of 350 kwh per household.

17 Claims, 6 Drawing Figures

CONVECTION BLOWER FOR CONVENTIONAL ELECTRIC OVENS

BRIEF SUMMARY OF THE INVENTION

This invention relates to energy saving electric oven appliances and particularly to a novel blower for converting a conventional electric oven into a more energy efficient convection oven.

It is well known that convection ovens which circulate very hot air throughout an oven cavity are much more efficient than the conventional radiating oven because the heat is evenly distributed in the oven cavity, a lower oven temperature may often be used, and food is cooked faster. For example, it can be shown that a conventional electrical kitchen oven which will roast a chicken in 87 minutes at a temperature of 375° F. will roast an identical chicken in 45 minutes at an oven temperature of 350° using the convection blower to be described, for a net energy savings of 55%. Similar tests using other food products show a net savings of about 57% for baked yeast breads, 42% for baked potatoes, 28% savings for a beef roast, 22% for baked ham. It can be shown that an average annual energy savings of 350 kilowatt-hours per household may be achieved by retrofitting a standard electric oven with the convection blower to be described.

The blower to be described employs a short, fractional horsepower motor manufactured by The General Electric Company to withstand oven temperatures to about 560° F. The motor operates on 110–120 volts, obtained within the conventional 220–240 volt oven circuitry.

Briefly described the convection blower includes the short motor housed for short profile, vertical shaft operation within a porcelain housing that is placed on the floor of the oven cavity between the conventional oven heating elements. The shaft extends from the top of the porcelain motor housing and supports a blower rotor which is housed within a low, larger diameter cylindrical blower housing having peripheral windows with air diverting sides which are non-radially angled with respect to a tangent to the surface of the housing to exhaust air at various directions into the oven cavity. The exhausted air is drawn in from a plurality of intake ports in the floor of the blower housing.

A novel feature of the blower system is that it takes its 110 volt power from the 220 volt oven circuitry. Insulated heat resistant wires extend from the blower motor through a guard spring to a porcelain male connector removably connected to a female connector. The female connector and one of the wires are coupled to an elongated conductive strip having an end clip which is physically attached to the grounded metal housing of the oven. The wire attached to the conductive strip is thus grounded while the second or "hot" wire is attached to one of the switched legs of the oven element so that the convection blower is energized along with the oven element and receives only the 115 volts existing between the one oven leg and grounded oven housing.

BRIEF DESCRIPTION OF THE DRAWINGS

In the drawings which illustrate the preferred embodiment of the invention.

DETAILED DESCRIPTION OF THE PREFERRED EMBODIMENT

Figure 1:
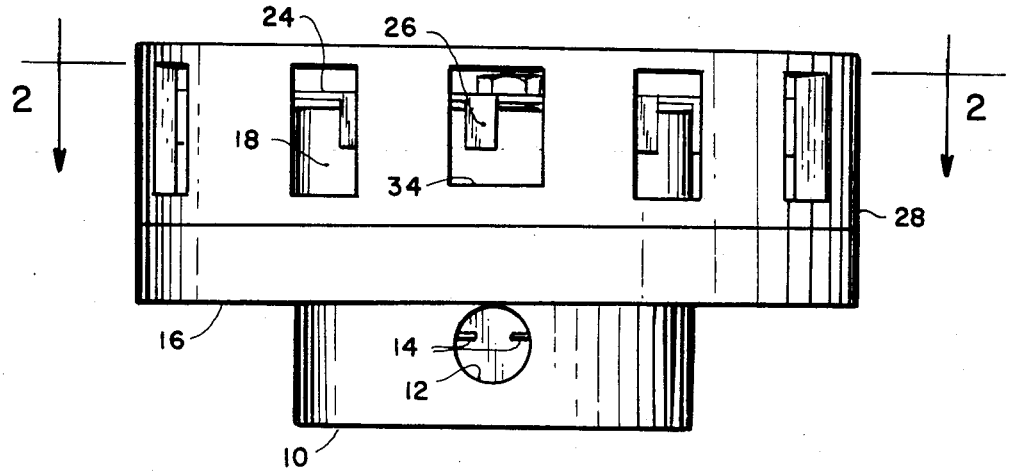
FIG. 1 is a side elevational view of the convection blower.

FIG. 1 is an elevational view of the convection blower and illustrates a circular motor housing 10 having a small circular opening 12 that reveals the two terminals 14 of a vertically mounted fractional horsepower motor. In the preferred embodiment, the motor housing 10 is made of glazed porcelain for easy cleaning. The lower end of the housing 10 is flat so that it may rest on the flat floor of a conventional electric oven and, in the preferred embodiment, the lower portion of the housing has an overall diameter of about four inches so that it may be positioned between the curved sections of the lower or baking element of the oven.

Figure 3:
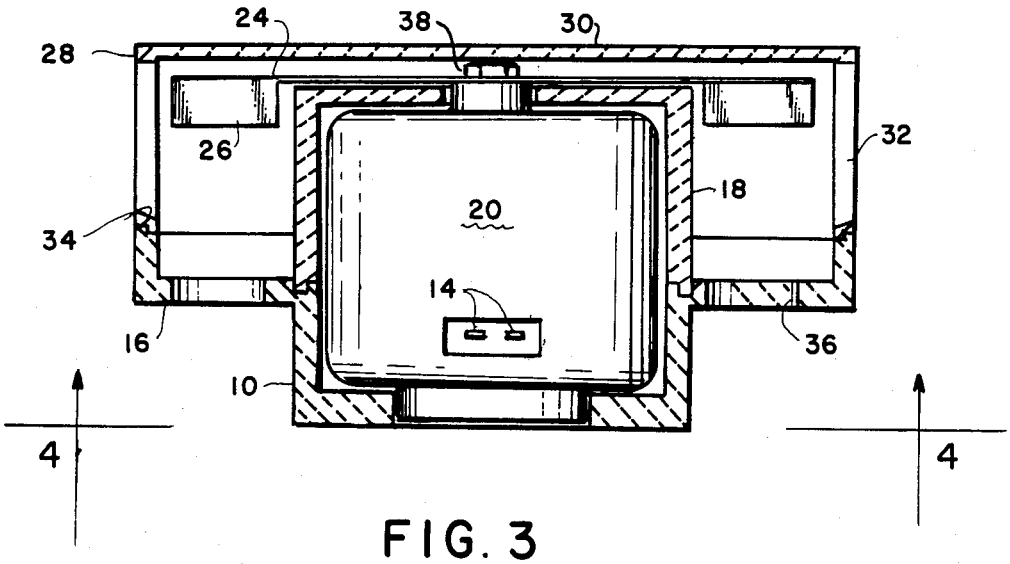
FIG. 3 is a sectional elevational view taken along the lines 3—3 of FIG. 2.

As best illustrated in the sectional elevational view of FIG. 3, the sides of the housing 10 extend vertically upward approximately 1.2 inches to a horizontal circular plate 16 having an outside diameter of about 7.5 inches. An upper section 18 of the motor housing extends up from the vertical portion of the housing 10 to substantially enclose the motor 20 to protect it from dirt and grease vapors that may be circulated by the blower. The rotatable motor shaft 22 extends through an axial hole through the top end surface of the upper section 18 and is attached to the center of a centrifugal vane blower 24, illustrated in detail in the plan view of FIG. 3.

Figure 2:
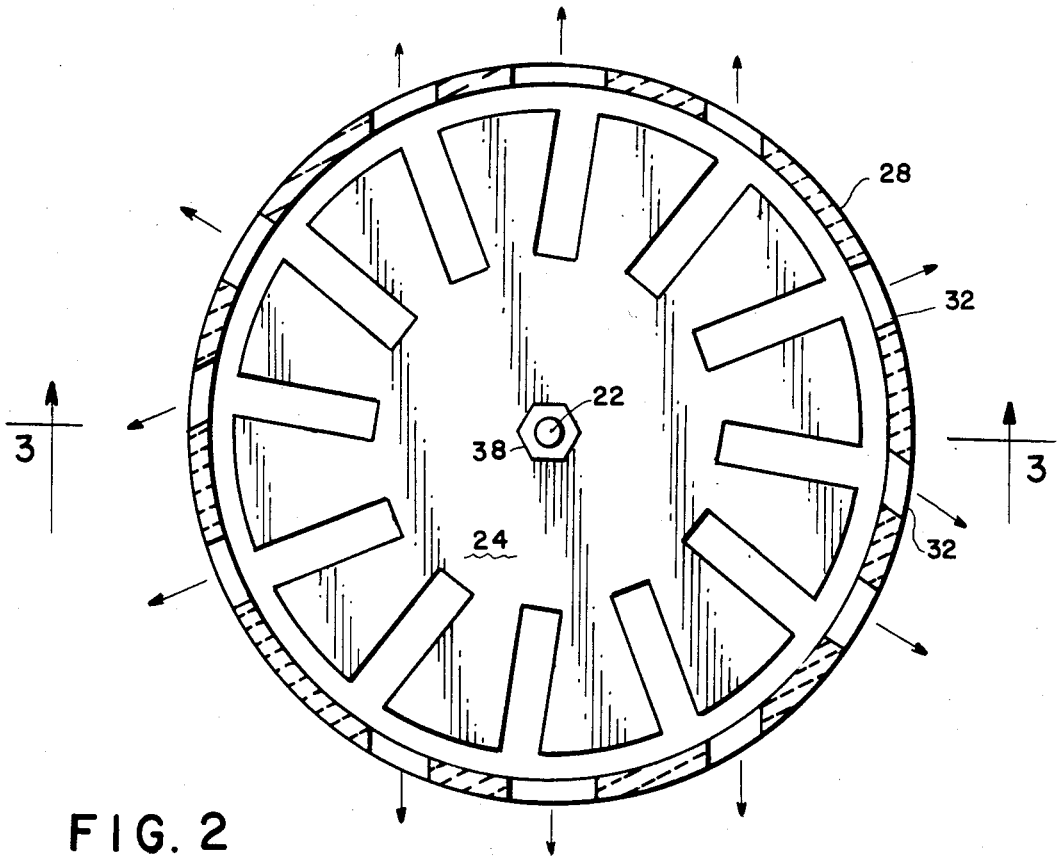
FIG. 2 is a sectional plan view taken along the lines 2—2 of FIG. 1.

As shown in FIGS. 2 and 3, the blower 24 comprises a flat circular disc divided into approximately twelve peripheral sectors, the end portions of which bend downward to form vanes 26. The vane portion of the blower disc are formed so that their inner edges are slightly spaced from the outer surface of the upper motor housing 18, and the outer edges of the vanes are similarly spaced from the inner surface of a blower housing 28. The blower housing 28 may also be formed of glazed porcelain and is generally cylindrical with an enclosed top 30. The lower peripheral edge of the cylindrical blower housing 28 meshes with the upper peripheral edge of the motor housing plate 16 to form an enclosed blower cage, and is readily removable from the motor housing for ease in cleaning.

The side walls of the cylindrical blower housing 28 contain a plurality of windows 32 which, because of the relative thickness of the porcelain walls, are preferably slanted at various angles as shown in the sectional plan view of FIG. 3 to direct the hot air being exhausted into various non-radial directions. As shown in FIG. 1, one or more windows, such as window 34, may have a slanted sill to direct the air into an upward direction.

Figure 4:
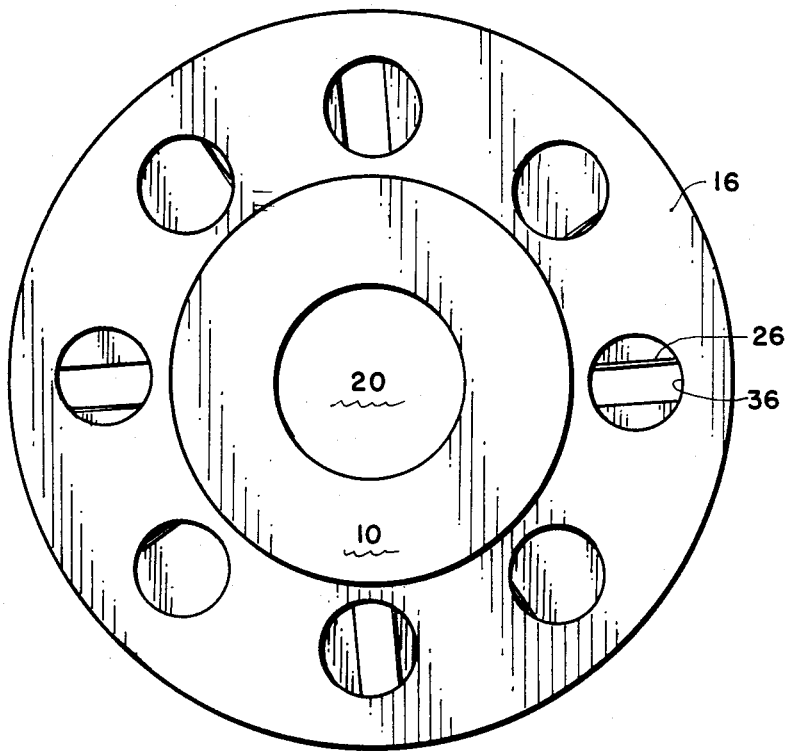
FIG. 4 is a bottom plan view taken along the lines 4—4 of FIG. 3.

The floor of the blower housing is the horizontal portion of the motor housing upper plate 16 and is formed with a plurality of holes 36 as shown in the bottom plan view of FIG. 4. Thus, when the motor rotates the blower, the vanes draw hot air in through the holes 36 and exhaust it in various directions through the blower housing windows 32.

As previously mentioned, the motor 20 and associated circuitry can operate at oven temperatures up to about 560° F. and must be removed from self-cleaning ovens before being subjected to those elevated temperatures. However, the conductive strip clipped to the oven and its attached female connector and wires coupled into the oven circuitry can withstand temperatures up to about 1100° and should not be removed. Before self-cleaning, the blower unit may be easily removed by disconnecting the male wire connector 40 illustrated in FIG. 5 as will subsequently be described. While so removed from the oven, the convection blower assembly may be easily disassembled and, after removal of the motor, may be placed in a conventional dishwasher for cleaning.

To dismantle the assembly, the blower housing 28 is lifted from its floor, the vane blower is removed from the motor shaft by removing the nut 38 and removing the blower from the motor shaft, the upper motor housing 18 is then lifted from the lower housing 10, and the motor is then removed together with electrical wire, the wire guard spring 44, and the porcelain wire connector 40. All elements are immersible for cleaning except the motor which, during operation, is contained within the lower housing 10 and upper housing 18 and not within the normal flow of oven dirt and greases.

Figure 5:
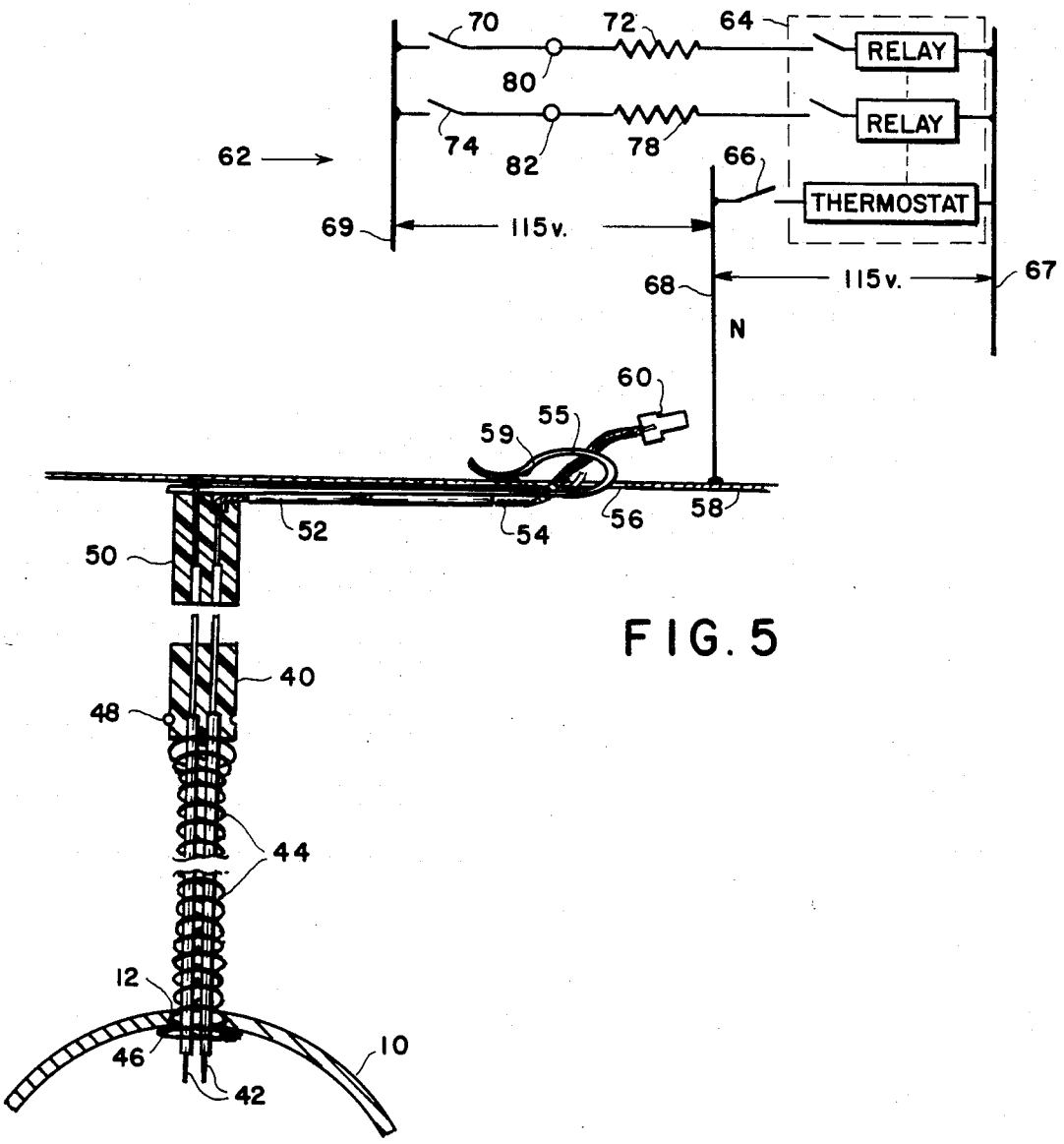
FIG. 5 is a schematic drawing of typical oven circuitry and illustrates the circuitry between the blower motor and oven.
Figure 6:
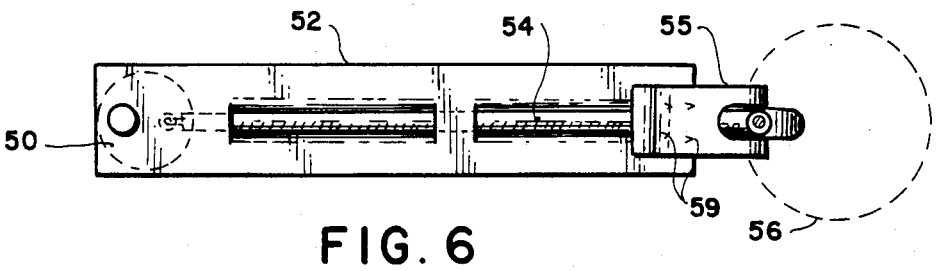
FIG. 6 is a detailed view of the oven grounding clip illustrated in FIG. 5.

The schematic drawing of FIG. 5 illustrates a typical 230 volt residential oven circuit and the connection thereto of the 110 volt convection blower. Illustrated in section FIG. 5 is a portion of the lower motor housing 10 having therein the round electrical connector hole 12 shown in FIG. 1, and a wire pair 42 leading from the motor power terminals 14 to the male connector 40. For physical protection of the wire pair 42, a wire guard spring 44 with a large diameter end 46 looped behind the connector hole 12 interconnects the motor housing 10 with an annular groove 48 in the connector 40. The pins in the male wire connector 40 engage corresponding terminals in a porcelain female connector 50. One of the terminals in the connector is connected directly to a resilient electrically conductive strip 52, the edge of which is illustrated in FIG. 5 and which is shown in the plan view of FIG. 6. An insulated wire 54 is connected to the second terminal in the connector 50 and exits through a small hole in the connectors side wall and into a raised wire retaining "tunnel" extending lengthwise through the strip 52 and to a point at which the resilient strip is curved around in a reverse direction to form an oven wall retaining clip 55.

To install the electrical power to the convection blower, the clip 55 on the conductive strip 50 is inserted into one of heating element terminal passage holes 56 in the oven rear wall 58 and then drawn back so that the clip 55 engages the metallic wall which, together with all exposed metal parts of an oven, is at electrical ground or neutral. To insure proper electrical contact between the clip 55 and an oven wall that may have a baked enamel surface, the clip is provided with a plurality of sharp points 59 through its conductive metal for piercing any coating in the rear wall. The points 59 should be positioned and properly aligned to permit easy installation of the clip and resist removal from the oven wall 58.

Illustrated in FIG. 5 is a diagram of a typical electrical oven circuit 62. A thermostat circuit 64 normally operates at 110–120 volts and includes a thermostat control potentiometer or switch 66 for selecting a desired oven temperature. The thermostat employs a temperature measuring thermocouple within the oven and closes a relay to energize a heating element whenever the measured oven temperature falls below the selected temperature. The thermostat relay is connected between a first leg 67 of a 230 volt power source and one end of the oven bake element 72 and broil element 78. The second end of the bake element is connected through an oven selector switch 70 to the second leg 69 of the 230 volt source. Similarly the second end of the broil element 78 is coupled through the oven selector switch 74 to the second leg 69 of the 230 volt source. The two selector switches are usually included in a single manual rotary control which may further include a "pre-heat" position that closes both selector switches 70, 74 to energize both the bake and broil elements. A potential of 115 volts is between the ground or neutral conductor 68 and either of the legs 67, 69.

The end of the insulated wire 54 to the convection blower is preferably provided with a conventional spade connector 60 which may be coupled to a divider or Y-spade connector to be installed between one of the spade connector ends of an oven element and its lead-in wire equipped with a female spade connector or screw fastener. Thus, the connector is inserted between one leg of a 230 volt source at an oven element and the neutral or grounded oven wall, so that the convection blower has only 115 volts applied thereto. The spade connector 60 may be connected to either side of either oven element to pick up the 115 volt power. However, it is generally preferable that the current to the convection blower be switched concurrently with the oven bake element without having to pass through an oven element or a thermostat relay. Therefore, the spade connector 60 should be attached to the end of the bake element 72 at the position 80 in the oven circuitry. If the bake element is not readily available, attachment may be made in the broil circuit by attaching the spade connector 60 and a Y-connector at the point 82.

Having thus described my invention, what I claim is:

1. A convection blower for electric ovens comprising:

a motor housing having a top, bottom and sides, said motor housing enclosing a motor having a rotatable vertically disposed shaft extending from the top of said housing;

a cylindrical blower housing enclosing a vaned blower rotor coupled to said vertically aligned motor shaft, said blower housing having a top surface and having a bottom floor surface coupled to said motor housing;

a plurality of spaced window openings in the cylindrical walls of said blower housing, at least one of said window openings being formed to divert air through the walls of said blower housing at a non-radial angle;

a plurality of spaced inlet openings in the bottom floor surface of said blower housing;

power input means for rotating said motor and said blower rotor for in drawing air through said plurality of spaced inlet openings and exhausting it through said plurality of window openings;

wherein said motor housing has cylindrical walls with an outside diameter less than the outside diameter of said blower housing and capable of being positioned on a floor of an electric oven and between the coils of a heating element therein;

wherein said cylindrical motor housing is comprised of a cylindrical lower unit for enclosing a lower portion of said motor and a cylindrical upper unit keyed to a top edge of said lower unit for easy removal therefrom, said upper unit having a top surface with a central hole for passage of the rotatable shaft of said motor;

wherein in the bottom floor of said blower housing forms a part of the cylindrical side wall of said lower motor housing unit; and wherein for easy removal a bottom edge of said cylindrical walls of said blower housing is keyed to a periphery of said bottom floor of said blower housing.

2. The convection blower claimed in claim 1 wherein said motor housing has cylindrical walls with an outside diameter less than the outside diameter of said blower housing and capable of being positioned on a floor of an electric oven and between the coils of a heating element therein.

3. The convection blower claimed in claim 2 wherein said cylindrical motor housing is comprised of a cylindrical lower unit for enclosing a lower portion of said motor and a cylindrical upper unit keyed to a top edge of said lower unit for easy removal therefrom, said upper unit having a top surface with a central hole for passage of the rotatable shaft of said motor.

4. A convection blower for circulating air throughout a conventional electric oven operable at approximately 230 volts, said blower including:

a housing having a substantially flat lower surface for removably positioning said blower on a floor of the electric oven and between the heating elements therein;

an electric motor within said housing, said motor operating at a potential of approximately 115 volts;

a blower attached to the rotatable shaft of said motor for circulating air through said housing and said electric oven; and means for electrically energizing said motor from the oven circuitry, said means including:

an insulated wire pair coupled between electrical input terminalsof said motor and a male wire connector;

a female connector removably coupled to said male connector;

an electrically conductive strip having a first end connected to said female connector and to a first wire of said wire pair;

a resilient reverse curved clip formed in a second end of said of said conductive strip for engaging, through a heating element opening, a portion of a neutral potential oven wall, said reverse curved clip having cut therein at least one sharp point positioned to permit attachment of said clip and to resist its removal from the oven wall; and a second wire of said wire pair being electrically coupled to one side of an oven element for supplying 115 volt power to said motor when said oven element is energized.

5. A method for supplying power to a 115 volt motor of a convection blower assembly positionable in the floor of a conventional 230 volt electric oven, said method comprising the steps of:

coupling a first electrical conductor of the motor to an electrically conductive wall of the electric oven, said wall being at a neutral potential; and electrically connecting a second conductor of said motor to an electrically conductive end of one heat element in said oven to thereby energize said motor whenever an element power selector switch is closed.

6. A convection blower for electric ovens comprising:

a motor housing having a top, bottom and sides, said motor housing enclosing a motor having a rotatable vertically disposed shaft extending from the top of said housing;

a cylindrical blower housing enclosing a vaned blower rotor coupled to said vertically aligned motor shaft, said blower housing having a top surface and having a bottom floor surface coupled to said motor housing;

a plurality of spaced window openings in the cylindrical walls of said blower housing, at least one of said window openings being formed to divert air through the walls of said blower housing at a non-radial angle;

a plurality of spaced inlet openings in the bottom floor surface of said blower housing; and power input means for rotating said motor and said blower rotor for in drawing air through said plurality of spaced inlet openings and exhausting it through said plurality of window openings;

said power input means including a high temperature, insulated wire pair coupled at their first end to input terminals of said motor, said wire pair terminating in a male connector removably coupled to a female connector coupled with a first of said wires in said wire pair to a first end of an electrically conductive strip, said strip having at one end a clip for engaging an opening in an electric oven wall at ground potential, a second of said wires in said wire pair being coupled to one end of a 230 volt oven heating element.

7. The convection blower claimed in claim 6 wherein said wire pair is physically protected within a wire guard spring connected between said motor housing and said male connector.

8. The convection blower claimed in claim 7 wherein said electrically conductive strip is elongated and supports said female connector at a first end, includes said oven engaging clip at a second end and is formed between said first and second ends to retain the second of said wires of said wire pair.

9. the convection blower claimed in claim 8 wherein said oven engaging clip is a resilient, reverse bent portion of said second end having formed therein a plurality of inward facing points positioned to permit attachment of said clip and resist removal thereof from said oven wall.

10. A method of supplying electrical power to an electric motor forming part of a portable convection blower assembly disengagably positionable within a conventional electric oven having an electric grounding point and connected to a source of electrical power which is accessible from within the oven, which is suitable for energizing said motor, and which is made available to said motor when a particular heat element within the oven is energized, said method comprising the steps of:

coupling a first electrical conductor of the motor to said electric grounding point whereby to ground said motor; and electrically connecting a second conductor of said motor to said source of electrical power from a point within the oven to thereby energize said motor when said particular heat element is energized.

11. In an electric radiating oven having an electric grounding point and connected to a source of electric power which is accessible from within the oven, which is suitable for energizing a particular electric motor, and which is made available to said motor when a particular heat element within the oven is energized, the improvement comprising a portable electric blower assembly retrofitted to and positioned on the floor of said oven for converting the oven to a convection oven,said blower assembly including:

an assembly housing arrangement including openings into and out of said housing for the passage of air within the oven;

said particular electric motor, the latter being disposed within said housing arrangement and including a first grounding conductor connected to said grounding point and a second power conductor connected to said source of power from a point within the oven whereby to energize said motor when said particular heat element is energized; and rotor means connected to and driven by said motor when the latter is energized whereby to produce a flow of air within said oven and through said housing arrangement so as to convert said radiating oven to a convection oven.

12. The improvement according to claim 11 wherein said source of electric power accessible from within said oven includes 230 volt circuit having available both 230 volt and 115 volt power, wherein said particular heat element is energized by said 230 volt power and wherein said motor is energized by said 115 volt power.

13. The improvement according to claim 11 wherein said electric motor includes electrical connecting means located outside said housing arrangement for manually disengagably connecting said first and second conductors to said grounding point and source of power, respectively, said motor otherwise being unconnected with the oven and said housing arrangement and rotor being unconnected with said oven whereby the housing arrangement, motor and rotor can be removed from the oven by merely manually disengaging said first and second conductors from said grounding point and source of power, respectively.

14. In an electric radiating oven having an electric grounding point and connected to a source of electric power which is accessible from within the oven, which is suitable for energizing a particular electric motor, and which is made available to said motor when a particular oven selector switch is closed, the improvement comprising a portable electric blower assembly retrofitted to and positioned within said oven, said blower assembly including:

an assembly housing arrangement;

said particular electric motor, the latter being disposed within said housing arrangement and including a first grounding conductor connected to said grounding point and a second power conductor connected to said source of power from a point within the oven whereby to energize said motor when said particular selector switch is closed; and rotor means connected to and driven by said motor when the latter is energized whereby to produce a flow of air within said oven so as to convert said radiating oven to a convection oven.

15. The improvement according to claim 14 wherein said source of electric power accessible from within said oven includes a 230 volt circuit having available both 230 volt and 115 volt power, wherein heat elements within said oven are energized by said 230 volt power and wherein said motor is energized by said 115 volt power.

16. The improvement according to claim 14 wherein said electric motor includes electrical connecting means located outside said housing arrangement for manually disengagably connecting said first and second conductors to said grounding point and source of power, respectively, said motor otherwise being unconnected with the oven and said housing arrangement and rotor being unconnected with said oven whereby the housing arrangement, motor and rotor can be removed from the oven by merely manually disengaging said first and second conductors from said grounding point and source of power, respectively.

17. A convection blower for electric ovens comprising:

a motor housing having a top, bottom and sides, said motor housing enclosing a motor having a rotatable vertically disposed shaft extending out from said housing;

a blower housing enclosing a blower rotor coupled to said motor shaft, said blower housing having side walls, a top surface and a bottom floor surface coupled to said motor housing;

a plurality of spaced first openings in the side walls of said blower housing;

a plurality of spaced second openings in the bottom floor surface of said blower housing; and power input means for rotating said motor and said blower rotor for drawing air through said blower housing between said first and second plurality of openings;

wherein said motor housing has side walls with an outside diameter less than the outside diameter of said blower housing and capable of being positioned on a floor of an electric oven and between the coils of a heating element therein;

wherein said motor housing is comprised of a lower unit for enclosing a lower portion of said motor and an upper unit keyed to a top edge of said lower unit for easy removal therefrom, said upper unit having a top surface with a central hole for passage of the rotatable shaft of said motor;

wherein the bottom floor of said blower housing forms a part of the side wall of said lower motor housing unit; and wherein for easy removal a bottom edge of said side walls of said blower housing is keyed to a periphery of said bottom floor of said blower housing.

* * * * *